US008272550B2

(12) United States Patent
Cheung

(10) Patent No.: US 8,272,550 B2
(45) Date of Patent: Sep. 25, 2012

(54) APPARATUS FOR SHOOTING A NAIL

(75) Inventor: Hon Kan Cheung, Hong Kong (HK)

(73) Assignee: Sun Grace Holdings Limited

( * ) Notice: Subject to any disclaimer, the term of this patent is extended or adjusted under 35 U.S.C. 154(b) by 358 days.

(21) Appl. No.: 12/578,607

(22) Filed: Oct. 14, 2009

(65) Prior Publication Data

US 2010/0243702 A1 Sep. 30, 2010

(30) Foreign Application Priority Data

Mar. 27, 2009 (CN) ..... 2009 2 0008966 U

(51) Int. Cl.
*B27F 70/02* (2006.01)

(52) U.S. Cl. ..... 227/130; 227/139; 227/120

(58) Field of Classification Search ..... 227/130, 227/139, 120
See application file for complete search history.

(56) References Cited

U.S. PATENT DOCUMENTS 3,437,250 A * 4/1969 Fiedler ..... 227/127
3,908,884 A * 9/1975 Schrepferman ..... 227/130
4,403,722 A * 9/1983 Nikolich ..... 227/8
4,483,473 A * 11/1984 Wagdy ..... 227/8
4,687,126 A * 8/1987 Brosius et al. ..... 227/10
4,821,938 A * 4/1989 Haytayan ..... 227/10
5,090,606 A * 2/1992 Torii et al. ..... 227/10
6,708,821 B2 * 3/2004 Tucker et al. ..... 206/345
7,243,829 B2 * 7/2007 Oda et al. ..... 227/9
7,600,662 B2 * 10/2009 Nayrac et al. ..... 227/120
2004/0188491 A1 * 9/2004 Huang ..... 227/120
2005/0001008 A1 * 1/2005 Sun ..... 227/131
2007/0114259 A1 * 5/2007 Bromley et al. ..... 227/120
2008/0223898 A1 * 9/2008 Rouger et al. ..... 227/8
2008/0283568 A1 * 11/2008 Nayrac et al. ..... 227/120
2010/0072248 A1 * 3/2010 Lai et al. ..... 227/130

* cited by examiner

*Primary Examiner* — Brian D Nash

(57) ABSTRACT

The present invention provides an apparatus for shooting a nail comprising a barrel, a barrel support, a centering sleeve, a link frame, a cylinder, a piston rod and an outer housing, wherein the barrel is mounted removably in the barrel support. As desired, the barrel may be removed conveniently to facilitate the replacement of the barrel for different application or removal of the nail blocked in the apparatus for shooting a nail. Furthermore, at least two longitudinally elongated slots may be formed in the centering sleeve and penetrate through the wall of the centering sleeve, the steel balls received in the slots are held in the slots via a snap ring so as to embrace the rod body of the piston rod. Therefore, it is ensured that the piston rod is concentric with the barrel when hitting the nail and the hit force of the piston rod will not lose.

19 Claims, 3 Drawing Sheets

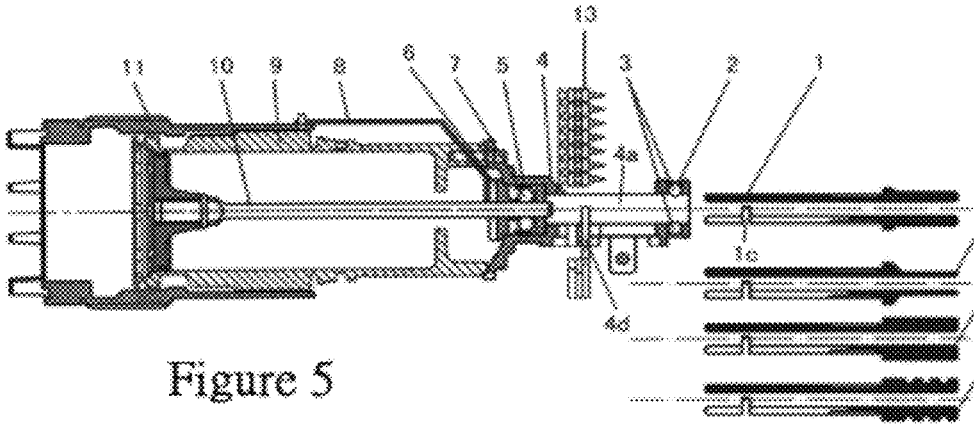
Figure 5
Figure 6
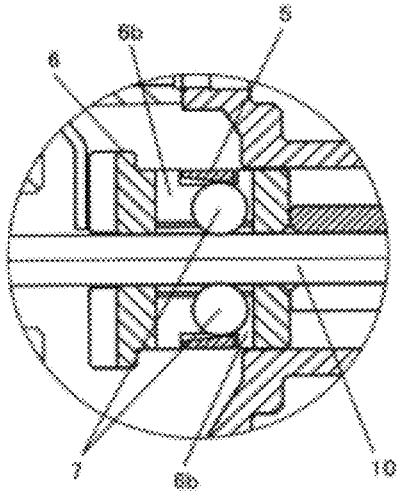
Figure 8
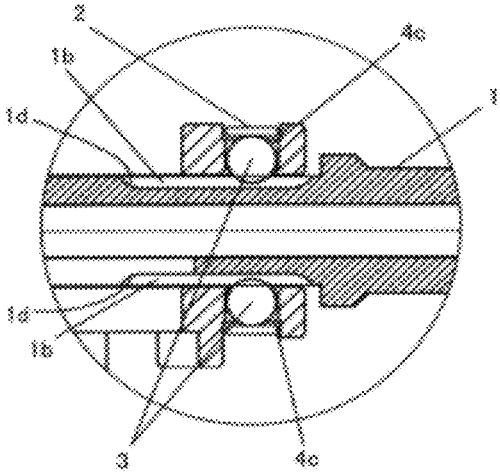
Figure 7

APPARATUS FOR SHOOTING A NAIL

FIELD OF THE INVENTION

The present invention relates to an apparatus for shooting a nail.

BACKGROUND OF THE INVENTION

An apparatus for shooting a nail is used widely in the construction industry. The apparatus for shooting a nail pushes a piston rod forwards by means of explosive force of a gunpowder or thrust of a compressed gas such that the piston rod boosts and shoots a nail from a nail feeder along a barrel. As a result, the nail is shot into a desired location.

In the conventional apparatus for shooting a nail, the barrel is fixedly mounted. It is usually difficult to eliminate a malfunction if the nail is blocked in the barrel. Moreover, it is impossible to replace a different type of barrel to meet different applications. Furthermore, to shoot the nail into a proper location, it is necessary to ensure that the piston rod is properly centered during its movement. The conventional apparatus for shooting a nail can not always ensure that the piston rod is properly centered during its movement.

SUMMARY OF THE INVENTION

An object of the present invention is to overcome the above-mentioned shortcomings in the prior art.

According to one aspect of the present invention, an apparatus for shooting a nail is provided, comprising:

a barrel having a nail passage therein;

a barrel support within a body of which a first receiving portion for receiving the barrel and a second receiving portion communicating with the first receiving portion are formed;

a centering sleeve having a through hole though its body and mounted movably in the second receiving portion;

a link frame with one end being connected with the centering sleeve;

a cylinder with one end being connected fixedly with the barrel support;

a piston rod including an elongated rod body and a piston disc, the piston rod being mounted movably in the cylinder such that the rod body passes through the cylinder and the through hole of the centering sleeve and aligns with the nail passage; and an outer housing with which the other end of the link frame is connected, a cylindrical cavity being formed within the outer housing and the cylinder being received within the cylindrical cavity, the centering sleeve, the link frame and the outer housing together being movable relative to the cylinder, thereby forming a closed chamber by the outer housing, the cylinder and the piston disc;

wherein the barrel is mounted removably in the barrel support.

According to another aspect of the present invention, an apparatus for shooting a nail is provided, comprising:

a barrel having a nail passage therein;

a centering sleeve having a through hole though its body;

a link frame with one end being connected with the centering sleeve;

a cylinder with one end being connected fixedly with the barrel;

a piston rod including an elongated rod body and a piston disc, the piston rod being mounted movably in the cylinder such that the rod body passes through the cylinder and the through hole of the centering sleeve and aligns with the nail passage of the barrel; and an outer housing with which the other end of the link frame is connected, a cylindrical cavity being formed within the outer housing and the cylinder being received within the cylindrical cavity, the centering sleeve, the link frame and the outer housing together being movable relative to the cylinder, thereby forming a closed chamber by the outer housing, the cylinder and the piston disc;

wherein at least two longitudinally elongated slots are formed in the centering sleeve and penetrate through the wall of the centering sleeve, the steel balls received in the slots are held in the slots via a snap ring so as to embrace the rod body of the piston rod.

According to the apparatus for shooting a nail of one aspect of the present invention, the barrel may be removed conveniently and quickly as desired to facilitate the replacement of the barrel for different application or removal of the nail blocked in the apparatus for shooting a nail.

According to the apparatus for shooting a nail of another aspect of the present invention, it is ensured that the piston rod is concentric with the barrel when hitting the nail and the hit force of the piston rod will not lose.

BRIEF DESCRIPTION OF THE DRAWINGS

FIG. 5 represents another longitudinal cross-section view of the apparatus for shooting a nail according to the present invention, in which the barrel has been pulled out of the barrel support;

FIG. 6 shows several barrels for different applications;

FIG. 7 represents a partially enlarged view showing a connection between the barrel and the barrel support; and FIG. 8 represents a partially enlarged view showing the engagement among a snap ring, a centering sleeve and the steel balls.

DETAILED DESCRIPTION OF THE EMBODIMENTS

Figure 1:
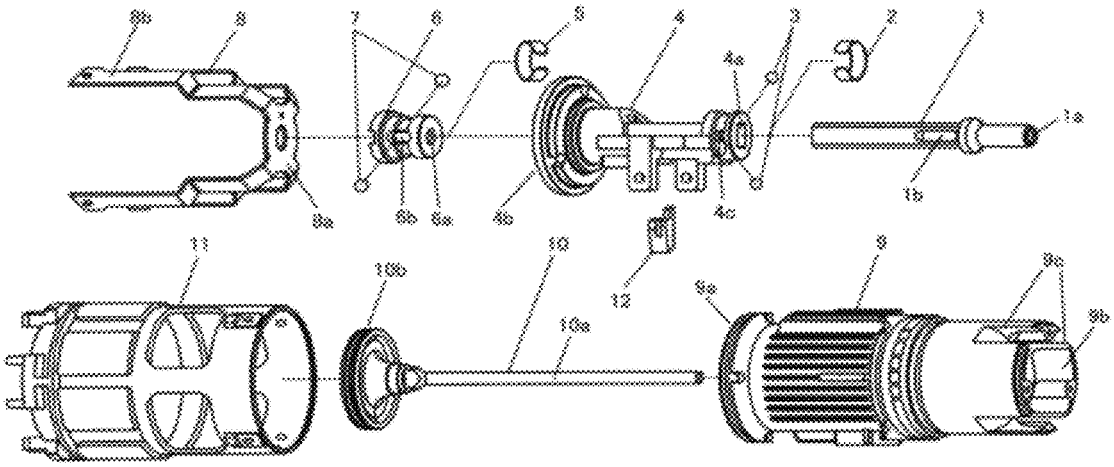
FIG. 1 represents an exploded perspective view of an apparatus for shooting a nail according to the present invention.

The apparatus for shooting a nail according to the present invention will be explained in detail below with reference to the accompany figures. Only the main components of the apparatus for shooting a nail according to the present invention are shown in the figures while some known components such as a trigger mechanism are not shown.

Referring to FIGS. 1, 2, 7 and 8, the apparatus for shooting a nail according to the present invention generally comprises a barrel 1, a barrel support 4, a centering sleeve 6, a link frame 8, a cylinder 9, a piston rod 10 and an outer housing 11.

A first receiving portion 4*a* for receiving the barrel 1 and a second receiving portion 4*b* for receiving the centering sleeve 6 and communicating with the first receiving portion 4*a* are formed within a body of the barrel support 4. The barrel 1 and the centering sleeve 6 are movably mounted in the barrel support 4. A through hole 6*a* is formed through a body of the centering sleeve 6. The link frame 8 includes a fitting disc 8*a* and four links 8*b* extending from the fitting disc 8*a*. The generally cylindrical cylinder 9 has respective openings 9*a*, 9*b* at its two ends and is formed with four elongated slots 9*c* in the cylindrical wall at one end. A stop 9*d* with a central opening 9*e* is disposed adjacent to a distal end of the elongated slots 9*c*. The piston rod 10 includes an elongated rod body 10*a* and a piston disc 10*b*. A generally cylindrical cavity 11*a* is formed within the outer housing 11.

Figure 2:
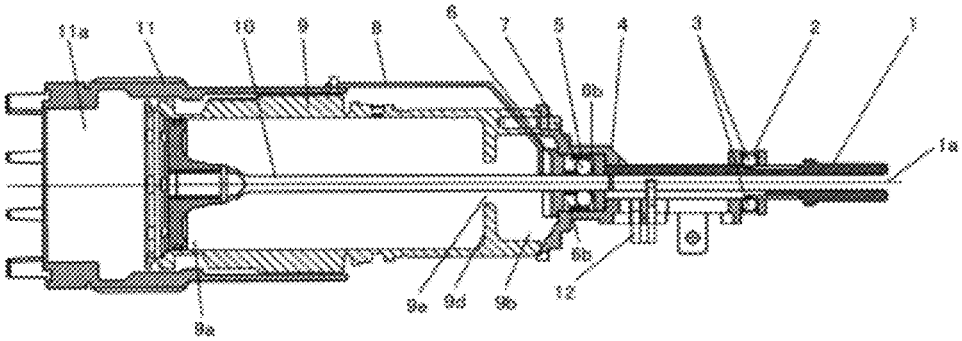
FIG. 2 represents a longitudinal cross-section view of the apparatus for shooting a nail according to the present invention.

During assembly, the barrel 1 is mounted snugly and movably in the first receiving portion 4*a* of the barrel support 4 and the centering sleeve 6 is mounted snugly and movably in the second receiving portion 4*b* of the barrel support 4. One end of the barrel support 4 in which the centering sleeve 6 is received is connected fixedly with one end of the cylinder 9 at which the slots 9*c* are formed. The link frame 8 connects with the centering sleeve 6 via the fitting disc 8*a*. The links 8*b* of the link frame 8 pass through the respective slots 9*c* on the cylinder 9 and are connected with the outer housing 11 at their free end. The piston rod 10 is mounted snugly and movably in the cylinder 9 such that the rod body 10*a* passes through the central opening 9*e* on the stop 9*d* of the cylinder 9 and the through hole 6*a* of the centering sleeve 6, and aligns with the nail passage 1*a* within the barrel 1. The end of the cylinder 9 opposite to the barrel support 4 is received within the out house 11 such that the outer housing 11 together with the link frame 8 and the centering sleeve 6 are movable relative to the cylinder 9. Referring to FIGS. 1, 2 and 7, the connection between the barrel 1 and the barrel support 4 is described in more detail below. Two longitudinally elongated grooves 1*b* are formed diametically and oppositely in the outer wall of the barrel 1. Through holes 4*c* are formed in the wall of the first receiving portion 4*a* of the barrel support 4 at the locations which correspond to the grooves 1*b*. The through holes 4*c* are used to receive a steel ball 3 respectively. The diameter of the opening of each through hole 4*c* adjacent to the first receiving portion 4*a* is smaller than that of the steel ball 3 such that the steel ball 3 is exposed partially to the first receiving portion 4*a* but does not fall into the first receiving portion 4*a*. The steel balls 3 are held within the through holes 4*c* by a snap ring 2 on its outside such that they do not drop out of the through holes 4*c*. The snap ring 2 always presses a portion of the steel ball 3 into the first receiving portion 4*a*. It should be understood that the number of the grooves 1*b* in the barrel 1 and the through holes 4*c* in the barrel support 4 may be more than two. In the case that the number is more than two, it is preferable that the grooves 1*b* and the through holes 4*c* are distributed uniformly in the barrel 1 and the barrel support 4 respectively. During assembly, in the case that the grooves 1*b* in the barrel 1 align with the through holes 4*c* in the barrel support 4 respectively, the barrel 1 is inserted into the first receiving portion 4*a* of the barrel support 4 and the steel balls 3 are pressed partially into the grooves 1*b* in the barrel 1 under action of the snap ring 2. The barrel 1 is held within the barrel support 4 by a combination of the snap ring 2 and the steel balls 3. Without external force, the barrel 1 can only move back and forth within the barrel support 4. To facilitate the insertion and the pullout of the barrel 1, it is preferable that an arcuated surface 1*d* is formed at an end of the grooves 1*b* from which the steel ball 3 enters and exits.

Referring to FIGS. 1, 2 and 8, the centering of the piston rod 10 is described in more detail below. Two longitudinally elongated slots 6*b* are formed diametically and oppositely in the centering sleeve 6, and the slots 6*b* penetrate through the wall of the centering sleeve 6. The steel balls 7 are received in the respective slots 6*b* and are held in the slots 6*b* via a snap ring 5. The combination of the centering sleeve 6, the snap ring 5 and the steel balls 7 is used to embrace the piston rod, as shown in FIG. 8. Preferably, the inner wall of the snap ring 5 forms a taper hole such that the inner diameter of the snap ring 5 reduces gradually in a direction towards the barrel 1, as shown in FIG. 8. It should be understood that the number of the slots 6*b* in the centering sleeve 6 may be more than two. In the case that the number is more than two, it is preferable that the slots 6*b* are distributed uniformly in the centering sleeve 6.

Figure 3:
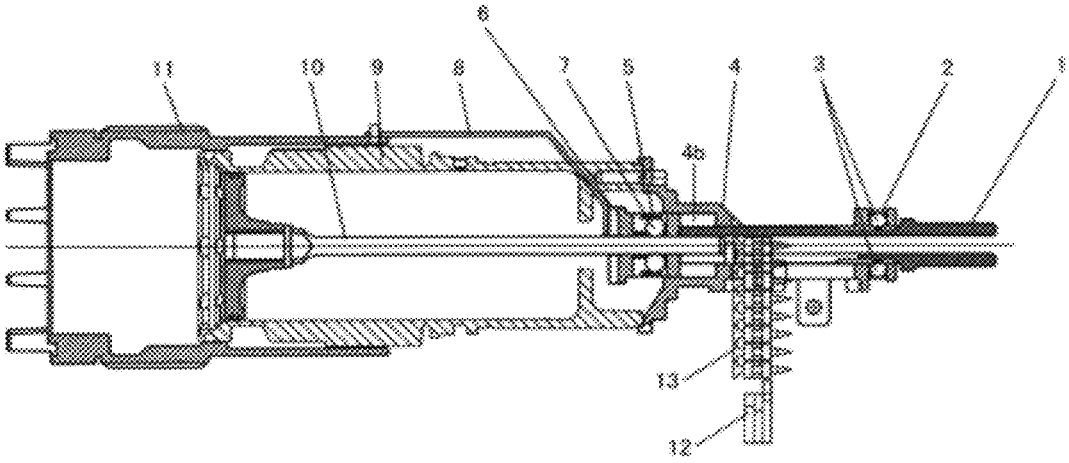
FIG. 3 represents another longitudinal cross-section view of the apparatus for shooting a nail according to the present invention, in which the barrel is pushed towards the barrel support to be ready to shoot the nail.

The apparatus for shooting a nail according to the present invention further comprises a nail feeder 12 which feeds the nail 13 into the barrel 1 through the openings in the barrel support 4 and in the barrel 1 to be shot, as shown in FIG. 3. The nail feeder 12 has a protrusion 12*a* at its upper end. The barrel support 4 and the barrel 1 are formed with a corresponding notch 4*d* and a corresponding notch 1*c* respectively. When the nails are used up, the protrusion 12*a* of the nail feeder 12 enters into the notch 1*c* in the barrel 1 through the notch 4*d* of the barrel support 4, as shown in FIG. 2. Meanwhile, the nail feeder 12 locks the barrel 1 such that the barrel 1 and the barrel support 4 can not move relative to each other. As a result, the apparatus for shooting a nail can not work. The apparatus for shooting a nail can work only after the protrusion 12*a* of the nail feeder 12 is pulled out of the notch 1*c* in the barrel 1.

Figure 4:
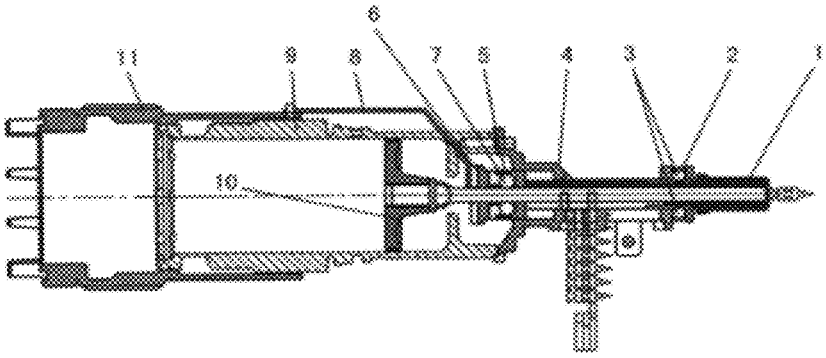
FIG. 4 represents another longitudinal cross-section view of the apparatus for shooting a nail according to the present invention, in which the piston rod has shot the nail out of the barrel.

Operation of the apparatus for shooting a nail according to the present invention is described below. In the case that the barrel 1 is locked as shown in FIG. 2, the protrusion 12*a* of the nail feeder 12 is pulled out of the notch 1*c* in the barrel 1. Meanwhile, the nails may be loaded into the nail feeder 12. Against a spring (not shown) disposed between the centering sleeve 6 and the cylinder 9, the barrel 1 is pushed towards the barrel support 4, then the barrel 1 in turn pushes the centering sleeve 6 such that the centering sleeve 6, the link frame 8 and the outer housing 11 together move away from the barrel support 4 relative to the cylinder 9. As a result, a closed chamber is formed by the outer housing 11, the cylinder 9 and the piston disc 10*b*, as shown in FIG. 4. When it is necessary to shoot the nail, the combustible gas is introduced into the closed chamber, fired and burned to explode, or a compressed gas is introduced directly into the closed chamber. The piston rod is driven by the high temperature gas or the high pressure gas to hit the nail so as to shoot the nail.

When it is necessary for the apparatus for shooting a nail according to the present invention to replace the barrels 1-2, 1-3 and 1-4 for other applications as shown in FIG. 5, the barrel 1 is forcefully pull out. Against the pressure effect of the snap ring 2 on the steel balls 3, it is possible to pull the barrel 1 out of the barrel support 4. Then, a barrel for other application may be inserted directly into the barrel support 4 to complete conveniently and quickly the replacement of the barrel. When it is necessary to remove the block of the nail in the barrel support, the barrel 1 is pulled out of the barrel support 4 in the same way. After the barrel 1 is pulled out, the barrel support 4 is run-through from the bottom up and it is possible to remove easily the blocked nail from the bottom up, as shown in the FIG. 5. After the barrel is reassembled, the apparatus for shooting a nail may be used again.

In order to facilitate aligning the grooves 1*b* in the barrel 1 with the through holes 4*c* in the barrel support 4 and aligning the nail inlet opening in the barrel 1 with the nail feeding direction of the nail feeder 12 when the barrel is inserted into the barrel support 4, the cross section of a portion of the barrel 1 to be inserted into the barrel support 4 may be rectangle, and the cross section of the first receiving portion 4*a* of the barrel support 4 is also rectangle correspondingly, thereby preventing the barrel 1 from rotating relative to the barrel support 4. It should be understood that the cross section of the portion of the barrel 1 to be inserted into the barrel support 4 and the cross section of the first receiving portion 4*a* of the barrel support 4 may be, for example, triangle, trapezoid or any other polygon, or ellipse.

By providing the centering sleeve 6, even if the barrel 1 has a full opening facing the barrel support 4 at the bottom side, the centering sleeve 6 may limit the rod body 10*a* of the piston rod to ensure that the piston rod is concentric with the barrel when hitting the nail. By providing the combination of the snap ring 5 and the steel balls 7 on the centering sleeve 6 and forming the inner wall of the snap ring 5 as a taper hole, when the piston rod moves towards the barrel to hit the nail, the steel balls 7 move together with the piston rod towards the end of the inner wall of the snap ring having a smaller diameter. The pressing force applied by the snap ring forms a resistance against the forward movement of the piston rod such that the piston rod can not move freely towards the barrel so as to ensure that the hit force of the piston rod will not lose. When the piston rod moves away from the barrel under a differential pressure, that is, when the piston rod resets, the steel balls 7 move together with the piston rod towards the end of the inner wall of the snap ring having a larger diameter. The pressing force applied by the snap ring gradually disappears, and the piston rod may reset easily without any resistance.

Although the preferred embodiments of the present invention are described in a non-limiting way in conjunction with the accompany figures, it should be understood that it is possible to make various modifications and variations to the present invention without departing from the scope claimed in the present invention and those modifications and variations will fall within the scope of the present invention. For example, in another embodiment, there is not a separate barrel support, the barrel is mounted directly to the cylinder, and the combination of above-mentioned snap ring and steel balls is provided on the centering sleeve.

The invention claimed is:

1. An apparatus for shooting a nail, comprising:

a barrel (1) having a nail passage (1*a*) therein;

a barrel support (4) within a body of which a first receiving portion (4*a*) for receiving the barrel (1) and a second receiving portion (4*b*) communicating with the first receiving portion (4*a*) are formed;

a centering sleeve (6) having a through hole (6*a*) through its body and mounted movably in the second receiving portion (4*b*);

a link frame (8) with one end being connected with the centering sleeve (6);

a cylinder (9) with one end being connected fixedly with the barrel support (4);

a piston rod (10) including an elongated rod body (10*a*) and a piston disc (10*b*), the piston rod (10) being mounted movably in the cylinder (9) such that the rod body (10*a*) passes through the cylinder (9) and the through hole (6*a*) of the centering sleeve (6) and aligns with the nail passage (1*a*); and an outer housing (11) with which the other end of the link frame (8) is connected, a cylindrical cavity (11*a*) being formed within the outer housing (11) and the cylinder (9) being received within the cylindrical cavity (11*a*), the centering sleeve (6), the link frame (8) and the outer housing (11) together being movable relative to the cylinder (9), thereby forming a closed chamber by the outer housing (11), the cylinder (9) and the piston disc (10*b*);

wherein the barrel (1) is mounted removably in the barrel support (4).

2. An apparatus for shooting a nail according to claim 1, wherein at least two longitudinally elongated grooves (1*b*) are formed in the outer wall of the barrel (1), the through holes (4*c*) are formed in the wall of the first receiving portion (4*a*) at the locations which correspond with the grooves (1*b*), the first steel balls (3) received within the through holes (4*c*) are exposed partially to the first receiving portion (4*a*) under the action of a first snap ring (2) but does not fall into the first receiving portion (4*a*), a portion of the first steel balls (3) which is exposed to the first receiving portion (4*a*) is received within the grooves (1*b*).

3. An apparatus for shooting a nail according to claim 2, wherein the grooves (1*b*) and the through holes (4*c*) are distributed uniformly in the barrel (1) and the barrel support (4) respectively.

4. An apparatus for shooting a nail according to claim 2, wherein an arcuated surface (1*d*) is formed at an end of the grooves (1*b*) from which the first steel balls (3) enter and exit.

5. An apparatus for shooting a nail according to claim 1, wherein the cross section of a portion of the barrel (1) to be inserted into the barrel support (4) and the cross section of the first receiving portion (4*a*) of the barrel support (4) are triangle, trapezoid, any other polygon, or ellipse.

6. An apparatus for shooting a nail according to claim 1, wherein the cross section of a portion of the barrel (1) to be inserted into the barrel support (4) and the cross section of the first receiving portion (4*a*) of the barrel support (4) are rectangle.

7. An apparatus for shooting a nail according to claim 1, wherein at least two longitudinally elongated slots (6*b*) are formed in the centering sleeve (6) and penetrate through the wall of the centering sleeve (6), the second steel balls (7) received in the slots (6*b*) are held in the slots (6*b*) via a second snap ring (5) so as to embrace the rod body (10*a*) of the piston rod.

8. An apparatus for shooting a nail according to claim 7, wherein the inner wall of the second snap ring (5) forms a taper hole such that the inner diameter of the second snap ring (5) reduces gradually in a direction towards the barrel (1).

9. An apparatus for shooting a nail according to claim 7, wherein the slots (6*b*) are distributed uniformly in the centering sleeve (6).

10. An apparatus for shooting a nail according to claim 1, further comprising a nail feeder (12) which feeds the nail (13) into the nail passage (1*a*) through the openings in the barrel support (4) and in the barrel (1) to be shot.

11. An apparatus for shooting a nail according to claim 10, wherein the nail feeder (12) has a protrusion (12*a*) at its upper end, and the protrusion (12*a*) of the nail feeder (12) is capable of inserting into a notch (1*c*) in the barrel (1) through the barrel support (4).

12. An apparatus for shooting a nail according to claim 1, further comprising a trigger mechanism for actuating the apparatus for shooting a nail.

13. An apparatus for shooting a nail according to claim 1, wherein the barrel support is run-through from the bottom up after the barrel is pulled out.

14. An apparatus for shooting a nail, comprising:

a barrel having a nail passage therein;

a centering sleeve having a through hole through its body;

a link frame with one end being connected with the centering sleeve;

a cylinder with one end being connected fixedly with the barrel;

a piston rod including an elongated rod body and a piston disc, the piston rod being mounted movably in the cylinder such that the rod body passes through the cylinder and the through hole of the centering sleeve and aligns with the nail passage of the barrel; and an outer housing with which the other end of the link frame is connected, a cylindrical cavity being formed within the outer housing and the cylinder being received within the cylindrical cavity, the centering sleeve, the link frame and the outer housing together being movable relative to the cylinder, thereby forming a closed chamber by the outer housing, the cylinder and the piston disc;

wherein at least two longitudinally elongated slots are formed in the centering sleeve and penetrate through the wall of the centering sleeve, the steel balls received in the slots are held in the slots via a snap ring so as to embrace the rod body of the piston rod.

15. An apparatus for shooting a nail according to claim 14, wherein the inner wall of the snap ring forms a taper hole such that the inner diameter of the snap ring reduces gradually in a direction towards the barrel.

16. An apparatus for shooting a nail according to claim 14, wherein the slots are distributed uniformly in the centering sleeve.

17. An apparatus for shooting a nail according to claim 14, further comprising a nail feeder which feeds the nail into the nail passage through the opening in the barrel to be shot.

18. An apparatus for shooting a nail according to claim 17, wherein the nail feeder has a protrusion at its upper end, and the protrusion is capable of inserting into a notch in the barrel.

19. An apparatus for shooting a nail according to claim 14, further comprising a trigger mechanism for actuating the apparatus for shooting a nail.

* * * * *